US005157221A

United States Patent [19]

Rönn

[11] Patent Number: 5,157,221

[45] Date of Patent: Oct. 20, 1992

[54] AMMUNITION UNIT WITH ADAPTIVE IMPACT FUZE

[75] Inventor: Torsten Rönn, Karlskoga, Sweden

[73] Assignee: AB Bofors, Bofors, Sweden

[21] Appl. No.: 622,828

[22] Filed: Dec. 5, 1990

[30] Foreign Application Priority Data

Dec. 14, 1989 [SE] Sweden ..... 8904210-5

[51] Int. Cl.[5] ..... F42C 19/07

[52] U.S. Cl. ..... 102/216

[58] Field of Search ..... 102/216, 206, 476

[56] References Cited

U.S. PATENT DOCUMENTS

| | | | |
|---|---|---|---|
| 1,704,302 | 3/1929 | Ruhlemann | 102/216 |
| 3,661,086 | 5/1972 | Thomanek et al. | 102/476 |
| 3,788,225 | 1/1974 | Held | 102/216 |

FOREIGN PATENT DOCUMENTS

| | | | |
|---|---|---|---|
| 529793 | 12/1954 | Belgium | 102/216 |
| 2630273 | 1/1978 | Fed. Rep. of Germany | 102/476 |
| 2541830 | 1/1979 | Fed. Rep. of Germany | 102/216 |
| 1075129 | 10/1954 | France | 102/216 |
| 1292321 | 3/1962 | France | 102/216 |

OTHER PUBLICATIONS

English translation of Precoul (French 1,292,321).

English Translation of Messerschmitt (German 2630273).

*Primary Examiner*—Stephen M. Johnson

*Attorney, Agent, or Firm*—Pollock, Vande Sande & Priddy

[57] ABSTRACT

An ammunition unit includes an impact fuse for sensing the hardness of a target and, based on the sensed hardness, triggering a burst inside, at or outside the target. The impact fuze includes a first sensor for sensing soft targets having a first outer cone with a conductive inner surface and a first inner cone surrounded by the first outer cone having a conductive outer surface. These conductive inner surfaces come in contact with each other upon an impact of the ammunition unit against a soft target due to deformation of the outer cone towards the first inner cone. A second impact sensor for sensing hard targets includes a second inner cone with a conductive outer surface and the first inner cone having also a conductive inner surface and surrounding the second inner cone, the first inner cone being deformable or displaceable towards the second inner cone with the conductive surfaces coming into contact with each other upon impact against hard targets, but not during impact against a soft target. The first and second impact sensors are connected to at least one signal-processing circuit, wherein a first activating signal generated by the first sensor causes a delayed activation of an element for effecting triggering of the explosive load of the ammunition unit and a second activating signal generated by the second sensor causes an instantaneous triggering of the explosive load.

10 Claims, 3 Drawing Sheets

AMMUNITION UNIT WITH ADAPTIVE IMPACT FUZE

FIELD OF THE INVENTION

The present invention relates to an ammunition unit with an adaptive impact fuze which is capable of sensing the hardness of a target or target part and on the basis of this makes possible a burst inside, at or outside the target. The impact fuze comprises or operates in conjunction with sensors which can be activated on sensing a soft or hard target or target part, respectively. The invention can be applied to different types of ammunition units, for example missiles, shells, and so forth.

BACKGROUND OF THE INVENTION

It has be known to design shells and the like sensitive to impact against soft or hard targets, respectively. A sensitive sensor member which is necessary for the impact against soft targets is placed in the nose of the shell and triggering is effected by means of the sensor member being activated via a pyrotechnical delay which activates the member effecting the triggering. On impact against a hard target, the front parts of the shell are damaged and the triggering member can be actuated without delay.

There is a need in this art for a relatively simple but nevertheless well operating, intelligent impact fuze which in real time senses the hardness of the target and determines whether the warhead will detonate outside the target or if the ammunition unit holds for penetration into the target. In the latter case, the ammunition unit can detonate inside the soft target and in this way the effect is increased in this type of target.

For example, anti-aircraft missiles must be effective against both small and large targets as well as hard and soft targets and against partly hard and partly soft targets. This requires significantly different operating characteristics. With an intelligent impact fuze, the penetration burst for soft targets can be combined with a shaped-charge effect against hard targets, and it should be possible to combine this with a bullet effect against small targets if required. It will be possible to utilize the invention, for example, in small anti-aircraft missiles with a wide target spectrum, for example battalion anti-aircraft missiles.

It will be possible to utilize different types of sensors and, if so desired, it will be possible to combine the impact functions with a proximity fuze function.

SUMMARY OF THE INVENTION

The present invention proposes an ammunition unit by means of which some or all of the above problems can be solved. The feature which can be principally be regarded as characterizing the new ammunition unit is that the sensors are connected to one or more signal-separating or signal-processing circuits in which a first activating signal generated by a sensor for sensing soft targets/target parts causes a delayed activation of the impact fuze/warhead of the ammunition unit and a second activating signal generated by a sensor for sensing hard targets/target parts causes an instantaneous triggering of the impact fuze/warhead.

In one embodiment of the invention the impact fuze on impact against a hard target/target part activates a shaped-charge in the ammunition unit. On impact against the target/target part the impact fuze will also be able to activate an explosive load with balls which is arranged inside the outer casing of the ammunition unit and/or is integrated in the propulsion level of the ammunition unit by means of powder metallurgy.

In further embodiments, the sensor for sensing a hard target/target part comprises contact foil, contact coating, strain gauges and so forth. The sensor for activation by soft targets preferably comprises contact foil or contact coating. In one embodiment, the impact functions will operate in conjunction with a proximity fuze function in the ammunition unit.

In a preferred embodiment, the impact fuze comprises a SAT (Safety Aiming Firing) device which is integrated with the explosive load of the ammunition unit in its rear parts.

The circuits which receive the activating signals from the sensors comprise a first electrical part circuit for receiving the first activating signal from the sensor for sensing a soft target. The first electrical part circuit can consist of a delay circuit which generates a signal which is delayed with respect to the first activating signal and which can be supplied to an element effecting the triggering of the warhead, for example the said SAT device. The circuits can also comprise a second electrical part circuit for receiving the second activating signal from the sensor for sensing a hard target. The second electrical part circuit can consist of a signal-processing circuit which, by processing the second activating signal, possibly with the aid of control processors of the ammunition unit, generates a triggering signal for the element effecting the triggering of the warhead. The circuits can also comprise an OR gate element or gate network via which the element effecting the triggering is connected to the sensors for sensing the hard target, to the delay circuit and sensor for sensing the soft target and possibly the proximity fuze. Furthermore, an ammunition unit construction is proposed in which the sensors are placed in the front parts of the ammunition unit.

Using the invention, an ammunition unit with high effectiveness against different types of target can be produced. The impact sensors for soft or hard targets, respectively, can be coupled together with a triggering device (SAT device) which is integrated with the warhead, and with the new impact fuze the hardness of the target/target part can be sensed in such a manner that activation of the warhead has the greatest possible effect.

In the text which follows, presently proposed embodiments of ammunition units exhibiting the characteristic features of the invention will be described, referring at the same time to the attached drawings, in which

DETAILED DESCRIPTION OF THE PREFERRED EMBODIMENT(S)

Figure 1:
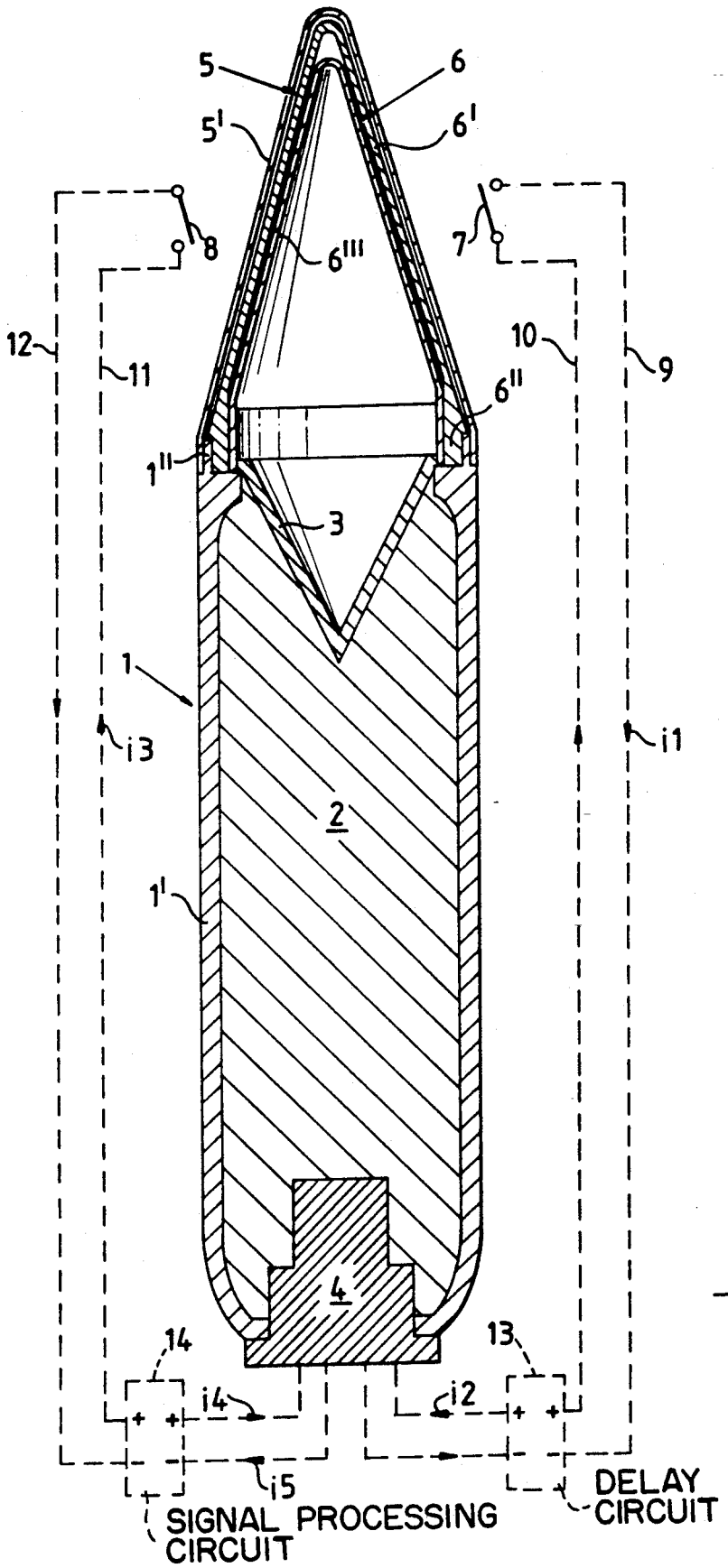
FIG. 1 shows in longitudinal section a first embodiment of a missile which is provided at the front with sensors for sensing a soft or hard target, respectively, explosive load, shaped charge and an element effecting the triggering (SAT device)

FIG. 1 shows an example of a missile construction which utilizes the present invention. The missile/ammunition unit 1 contains in a known manner an explosive load 2. At the front the missile is provided with an inside cone 3 which is part of the shaped-charge.

The missile is provided with an element effecting the triggering of the explosive load in the form of a SAT device 4 (for example of EFI type). The device 4 operates in conjunction with impact sensors 5 and 6 for a soft and hard target, respectively.

The sensor 5 for soft impact comprises a first hollow outer nose cone 5' of soft material, for example plastic, which is covered with electrical contact material on its inside. There is also an inner first hollow nose cone 6' which is provided with electrical contact material on its outer surface. The inner and outer cones are arranged in such a manner that, when the point of the ammunition unit hits against a soft target, the outer cone 5' is deformed or shifted in position relative to the inner cone such that the electrical coatings come into contact with each other. This can thus be considered as a first make contact 7 which is closed on impact against a soft target. It is known how to arrange a soft impact contact in this manner which is why this function is only shown in principle.

The sensor 6 also utilizes the first hollow inner cone 6' which at its bottom is placed via its end edge 6'' in the front part of the casing 1' of the ammunition unit 1. In the front part, the casing of the ammunition unit is provided with a protruding outer flange 1'' in which the cone 6' is supported via its back edge 6''.

The support is arranged in such a manner that the position of the inner hollow cone 6' is essentially unaffected by the impact of the ammunition unit against a soft target but it is deformed or displaced on impact against a hard target.

The sensor 6 also comprises a second inner cone 6''' which is supported in the hollow inner cone 6'. The cone 6' is provided on its inside with electrical contact material and the cone 6''' is provided on its outside with electrical contact material. No contact exists or occurs on impact against a soft target. On the other hand, contact occurs between the contact coatings of cones 6' and 6''' on impact against a hard target due to deformation or displacement of the cones. In this manner, the coatings of the cones 6' and 6''' can be considered to form a second make contact 8 which is operated on impact against hard targets but remains inoperative on impact against soft targets. The establishment of a contact of this type between coatings on parts which can be actuated by impact (hard) is already known and is therefore only shown in principle.

Figure 1A:
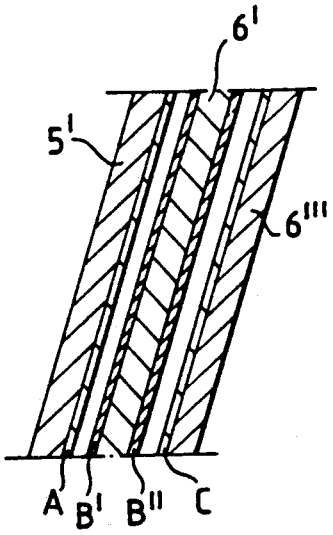
FIG 1*a* shows parts of the design of the nose part of the missile according to FIG. 1.

FIG. 1*a* shows parts of the cones 5', 6', and 6'''. The coating on the inside of cone 5' is shown by A. The coatings on the outside and inside of cone 6' are shown by B' and B'', respectively. The coating on the outside of cone 6''' is shown by C. If the cone 6' is constructed of conducting material, no coating is required.

In FIG. 1 it has been specified that contacts 7 and 8 close electrical circuits, the conductors of which are marked as 9, 10 and 11, 12, respectively (one conductor of which in each case can be formed by the body of the ammunition unit). Conductors 9, 10 are connected to a delay circuit 13 to which is delivered a first activating signal il generated by contact 7. Depending on the first activating signal il, the delay circuit 13 generates a signal 12 which is delayed in relationship to the signal il. The signal i2 is adapted in such a manner that it can activate the device 4, which activation takes place in a known manner. The delay time is selected such that the ammunition unit has time to penetrate into the target before it detonates. The delay time depends on the target type, size, and the like.

An activation of contact 8 results in a signal i3 being supplied to a signal processing circuit (matching circuit) 14 which, as a function of the signal i3, generates a signal i4 which is adapted in such a manner that a direct operation (without delay) of the SAT device 4 is produced. The circuits 13 and 14 can be constructed in known manner and by means of known space-saving technology. The circuits 13 and 14 supply the conductors 9, 10 and 11, 12 with power and the circuits can use any processors in the missile or corresponding devices for their signal processing. The circuit 14 can be omitted in one embodiment.

Figure 2:
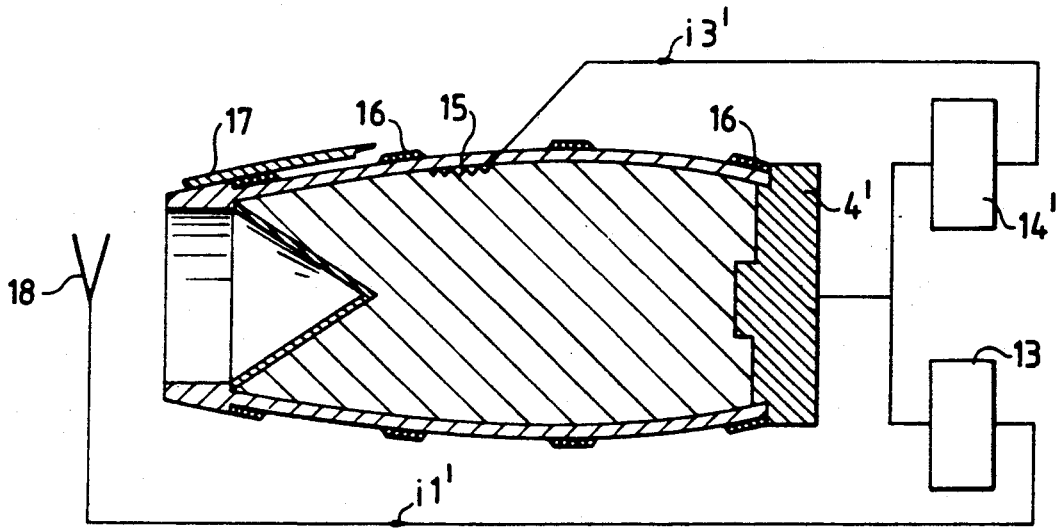
FIG. 2 shows in longitudinal section parts of a second embodiment of the ammunition unit.

FIG. 2 shows an ammunition unit of a different type (shell) where a strain gauge 15 of known type is utilized as sensor for sensing a hard target. On compression of the ammunition unit in connection with an impact against the hard target/target part, the resistance in the strain gauge/strain gauges is changed, with the result that the signal i3' is changed. The change is sensed by the circuit 14' which is of the same type as circuit 14. The circuit 13' acts in a manner corresponding to that of the circuit 13. The ammunition unit is also provided with balls 16 which are arranged inside the outer casing 17 of the unit, which is shown only partly in FIG. 2. The impact sensor for sensing a soft target is shown as 18. Functions of the embodiment according to FIG. 2 which are not described correspond to corresponding functions in the embodiment according to FIG. 1 described above. Thus, for example, the signal from sensor 18 is indicated i1'.

Figure 3:
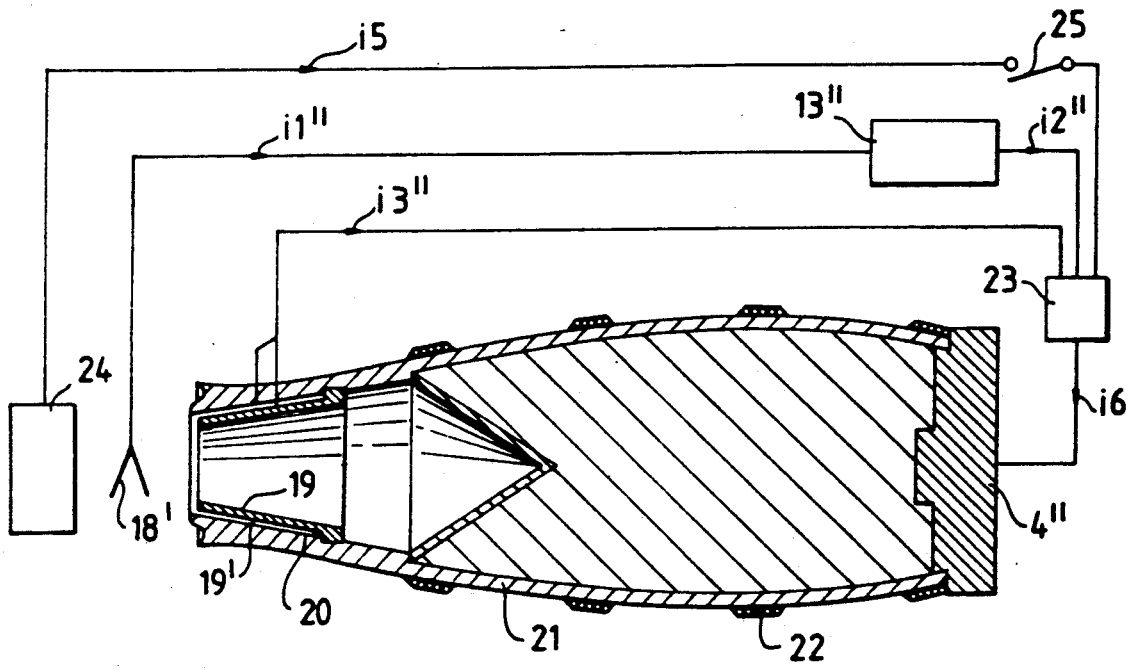
FIG. 3 shows in longitudinal section a third embodiment of the ammunition unit.

In the embodiment according to FIG. 3, an inner cone 19 is utilized as sensor for an impact against a hard target. The cone is constructed with contact coating 19' on its outside. This (electrical) contact coating can operate in conjunction with a contact coating 20 on an inner surface on the front parts of the casing 21. The cone 19 operates in accordance with the same principle as the cone 6' in FIG. 1. On impact against a soft target, the cone is not moved out of its position in relationship to the coating 20. On impact against a hard target, contact is obtained between the coatings 19' and 20'. Also in this embodiment, balls 22 arranged inside an outer casing (not shown) are included. The outer casing, as in according to FIG. 2, can be constructed of metal, fibre-reinforced plastic, carbon fibre of the like. The sensor for the soft impact is here designated by 18' and the signal generated by this sensor is designated by il''. The delay circuit has the designation 13 and the signal coming from the delay circuit is i2''. The sensor for impact against a hard target delivers the signal i3''. In this case, the impact sensors have been combined with a proximity-fuze function which is symbolized by 24. On activation of the proximity-fuze function, a signal i5 is obtained. The proximity-fuze function is arranged in such a manner that it can be coupled out by means of a contact 25. Coupling out can be done, for example, when the ammunition unit is to be utilized for direct-impact firing against targets. In this case, a signal processing circuit 23 is included which operates as an OR gate. When a signal of sufficient amplitude is obtained from any of the impact sensors or the proximity fuze, the circuit 23 generates a signal i6 which can trigger the device 4'', compare device 4, 4' in FIGS. 1 and 2, respectively.

Figure 4:
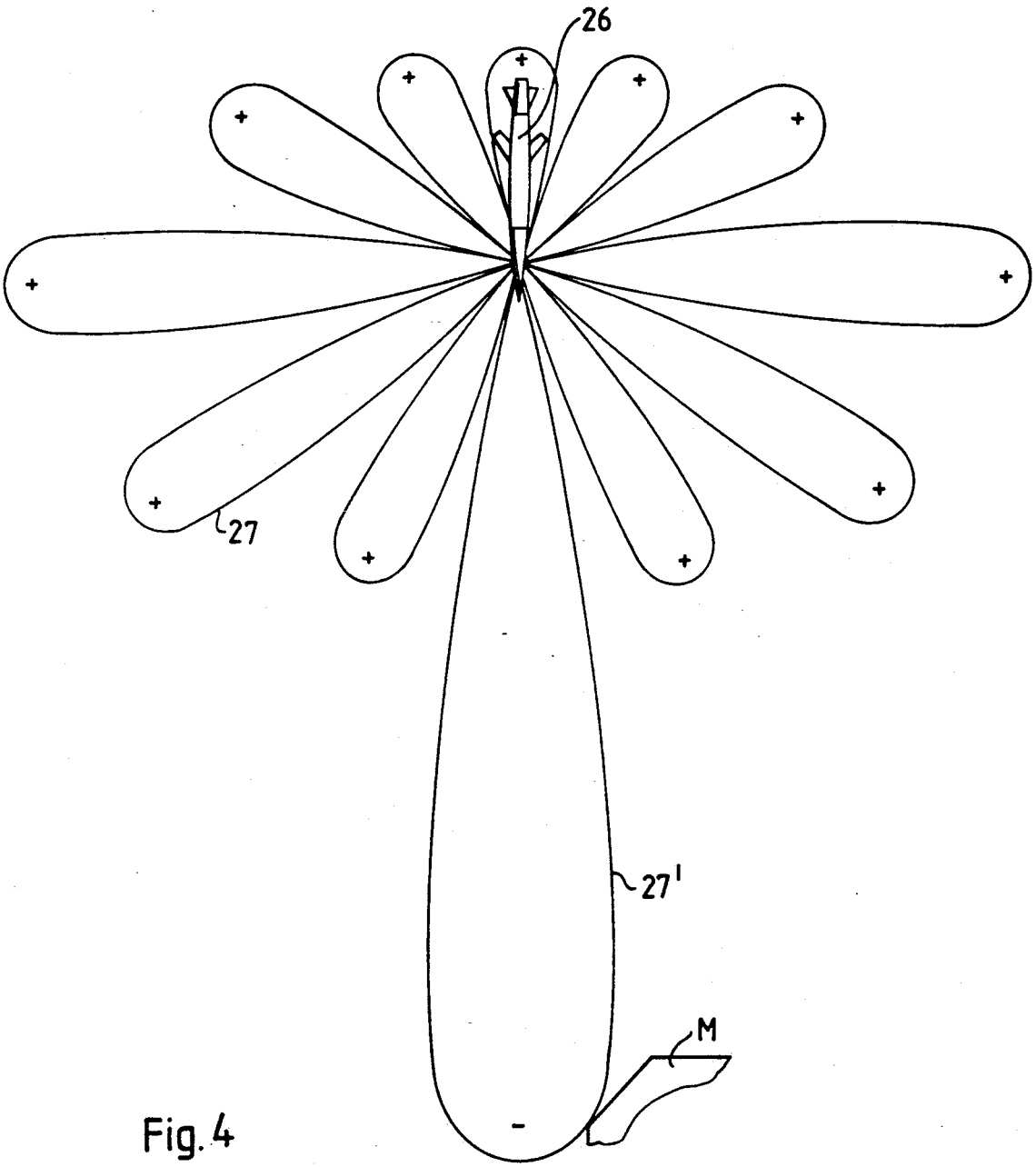
FIG. 4 shows in a horizontal section the proximity fuze of the missile.

FIG. 4 shows an embodiment in which the ammunition unit 26 is constructed with a proximity-fuze function, the sensing lobes 27 of which are shown. The lobes 27 are pointed in different directions and provide a burst on sensing a target. In this case, the proximity fuze is equipped with a forward-directed lobe 27', a so-called impact override, which blocks the burst triggering of the other proximity-fuze lobes upon target sensing. In the figure, a target is specified by M.

The invention is not restricted to the embodiment described above as an example, but can undergo modifications within the context of the patent claims following and the concept of the invention.

I claim:

1. An ammunition unit including an adaptive impact fuse for sensing the hardness of a target and, on the basis of the sensed hardness triggering a burst inside, at or outside the target, said impact means, including:

a first sensing means for sensing soft targets including a first outer cone having a conductive inner surface and a first inner cone surrounded by said first outer cone and having a conductive outer surface, said conductive inner surface of said first outer cone and said conductive outer surface of said first inner cone being adapted to come in contact with each other upon impact of said ammunition unit against said soft targets due to deformation or displacement of said first outer cone towards said inner cone; and a second impact sensing means for sensing hard targets including a second inner cone having a conductive outer surface and said first inner cone having also a conductive inner surface and surrounding said second inner cone, said first inner cone being deformable or displaceable towards said second inner cone with said conductive surfaces coming into contact with each other upon impact against said hard targets, but not upon impact against said soft targets, said first and second impact sensing means being connected to at least on signal-processing circuit, wherein a first activating signal generated by said first impact sensing means for sensing said soft targets causes a delayed activation of means for effecting triggering of the explosive load of the ammunition unit and a second activating signal generated by said second sensing means for activation by said hard targets causes an instantaneous triggering of said explosive load.

2. An ammunition unit according to claim 1, wherein said impact fuse, on impact against said hard targets, activates a shaped charge in a warhead of said ammunition unit.

3. An ammunition unit according to claim 2, wherein the impact fuse comprises a triggering device which is integrated with the explosive load of the ammunition unit near its rear parts.

4. An ammunition unit according to claim 2, wherein said signal processing circuit comprises a fist electrical circuit for receiving the first activating signal from said first impact sensing means including a delay circuit which generates a signal which is delayed in relation to the first activating signal and which can be supplied to said means effecting the triggering of the warhead.

5. An ammunition according to claim 2, wherein the shaped charge and said first and second impact sensing means are mounted in front parts of the ammunition unit and wherein said means for effecting the triggering is placed in rear parts of the explosive load.

6. An ammunition unit according to claim 1, wherein the impact fuse comprises a triggering device which is integrated with said explosive load of said ammunition unit in its rear parts.

7. An ammunition unit according to claim 6, wherein said signal processing circuit also comprises a second electrical circuit for receiving the second activating signal from said second impact sensing means and wherein the second electrical circuit includes a signal processing means which, by processing the second activating signal, generates a triggering signal to said means effecting the triggering of the warhead, when said second impact sensing means is activated on impact against said hard targets.

8. An ammunition unit according to claim 1, wherein said signal processing circuit comprises a first electrical circuit for receiving said first activating signal from said first impact sensing means including a delay means which generates a signal which is delayed with respect to said first activating signal and which can be supplied to said means effecting the triggering of said explosive load.

9. An ammunition unit according to claim 8, wherein said signal processing circuit also comprises a second electrical circuit for receiving the second activating signal from said second impact sensing means, and wherein said second electrical circuit includes a signal processing means which, by processing the second activating signal, using control processors of said ammunition unit generates a triggering signal to said means effecting the triggering of said explosive load, when the second impact sensing means is activated on impact against said hard targets.

10. An ammunition unit according to claim 1, wherein the shaped charge and said first and second impact sensing means are mounted in front parts of the ammunition unit and wherein said means for effecting the triggering is placed in rear parts of the explosive load.

* * * * *